United States Patent [19]

Sievert

[11] 4,393,814

[45] Jul. 19, 1983

[54] MULTI-FUELED BOILER

[76] Inventor: Raymond Sievert, 790 Old Colony Rd., Meriden, Conn. 06450

[21] Appl. No.: 252,254

[22] Filed: Apr. 8, 1981

[51] Int. Cl.[3] ..... F22B 31/04

[52] U.S. Cl. ..... 122/22; 122/2; 122/211

[58] Field of Search ..... 122/22, 211, 2, 149; 110/169

[56] References Cited

U.S. PATENT DOCUMENTS

| | | | |
|---|---|---|---|
| 851,183 | 4/1907 | Shoemaker | 122/22 X |
| 1,154,877 | 9/1915 | Moore | 122/22 X |
| 1,456,707 | 5/1923 | Nystrum | 110/169 |
| 4,206,723 | 1/1980 | Kunkel | 122/22 |
| 4,296,711 | 10/1981 | Bilberg | 122/22 |

FOREIGN PATENT DOCUMENTS

| | | | |
|---|---|---|---|
| 631206 | 4/1963 | Belgium | 122/2 |
| 2278040 | 8/1974 | France | 122/2 |

*Primary Examiner*—Edward G. Favors

[57] ABSTRACT

An improved multi-fueled hot water or steam boiler comprising a plurality of compartments, one compartment for the combustion of a solid fuel, such as wood or coal, and the other for the combustion of a liquid fuel and separated from each other and the exterior of the boiler by water-conducting walls; a water supply tank positioned above one of the compartments and connected to the water-conductive walls; and a plurality of horizontal fire tubes passing through the water supply tank and connecting one compartment to an exhaust flue. The compartment not positioned below the water supply tank has a water-conductive ceiling slanted upwardly toward and connected to the water supply tank. One compartment has an adjustable air-flow secondary damper in addition to a primary air damper. The water-conductive walls, fire tubes, adjustable secondary damper, and upwardly slanting water-conductive ceiling reduce boiler heat losses and improve boiler efficiency.

8 Claims, 4 Drawing Figures

MULTI-FUELED BOILER

FIELD OF THE INVENTION

This invention relates to an improved hot water or steam boiler and in particular to a more efficient boiler which can burn a solid and a liquid fuel simultaneously or at different times.

BACKGROUND OF THE INVENTION

The conventional single-fueled boilers of the prior art usually operate on either oil, gas, wood or coal. Boilers operating on coal have often been replaced with more convenient, cleaner oil-fired boilers. Shortages of oil can, however, make coal more competitive in price, although there are air pollution problems associated with its use. Thus, a single-fueled boiler installation lacks the flexibility to cope with fluctuating supplies and prices. Furthermore, seasonal fluctuations in temperature may make one fuel preferable at one time of the year and another at another time. Because of these factors boilers which can simultaneously operate using two or more fuels have been developed. However, these multi-fueled boilers do not always operate at peak efficiency. It is difficult to construct a boiler which can burn two fuels, one solid and one liquid, with combustion efficiency. For example, ash from a solid combustion can interfere with operation of a gas or oil burner. Furthermore, air pollution problems are more complex when two fuels are burned at the same time, or at different times, in the same boiler.

It is an object of this invention to provide an improved multi-fueled boiler having increased efficiency of combustion.

It is also an object of this invention to provide an improved efficiency multi-fueled boiler using a solid fuel such as coal and a liquid fuel such as oil simultaneously or separately.

It is a further object of this invention to provide an improved multi-fueled boiler having a cooler, more completely burned flue gas effluent so as to decrease air-pollution.

It is also an object of this invention to provide a boiler which can conveniently operate simultaneously on or switch between fuels to provide improved economy and greater efficiency.

It is yet another object of this invention to provide a boiler which uses at least two fuels so as to provide more flexibility during shortages of a particular fuel.

SUMMARY OF THE INVENTION

The novel multi-fueled boiler of this invention comprises a plurality of compartments, each of said compartments being dedicated to the combustion of a fuel, and a water supply tank positioned above at least one of the compartments so as to receive heat from the hot gases produced by combustion in said compartments and thus produce either hot water or steam.

The compartments are separated from each other and the exterior by water-conductive walls connected to the water supply tank. At least one compartment not positioned below the water supply tank has a water conductive ceiling slanted upwardly toward and connected to the water supply tank. A plurality of fire tubes pass through the water supply tank and connect at least one compartment with a flue for exhausting combusted gases. in addition to a conventional damper for primary air, at least one compartment has a secondary damper which provides an adjustable flow of secondary air.

The water-conductive compartment walls and ceilings connected to the water supply tank and the horizontal-fire tubes result in a marked improvement in the combustion efficiency of the boiler by reducing heat losses. Furthermore, the increased path traveled by hot combustion gases and adjustable secondary air flow results in cooler effluent gases containing less unburned matter.

BRIEF DESCRIPTION OF THE DRAWINGS

The invention may be better understood from the following detailed description which refers to the accompanying drawings in which.

DETAILED DESCRIPTION OF THE INVENTION

Figure 1:
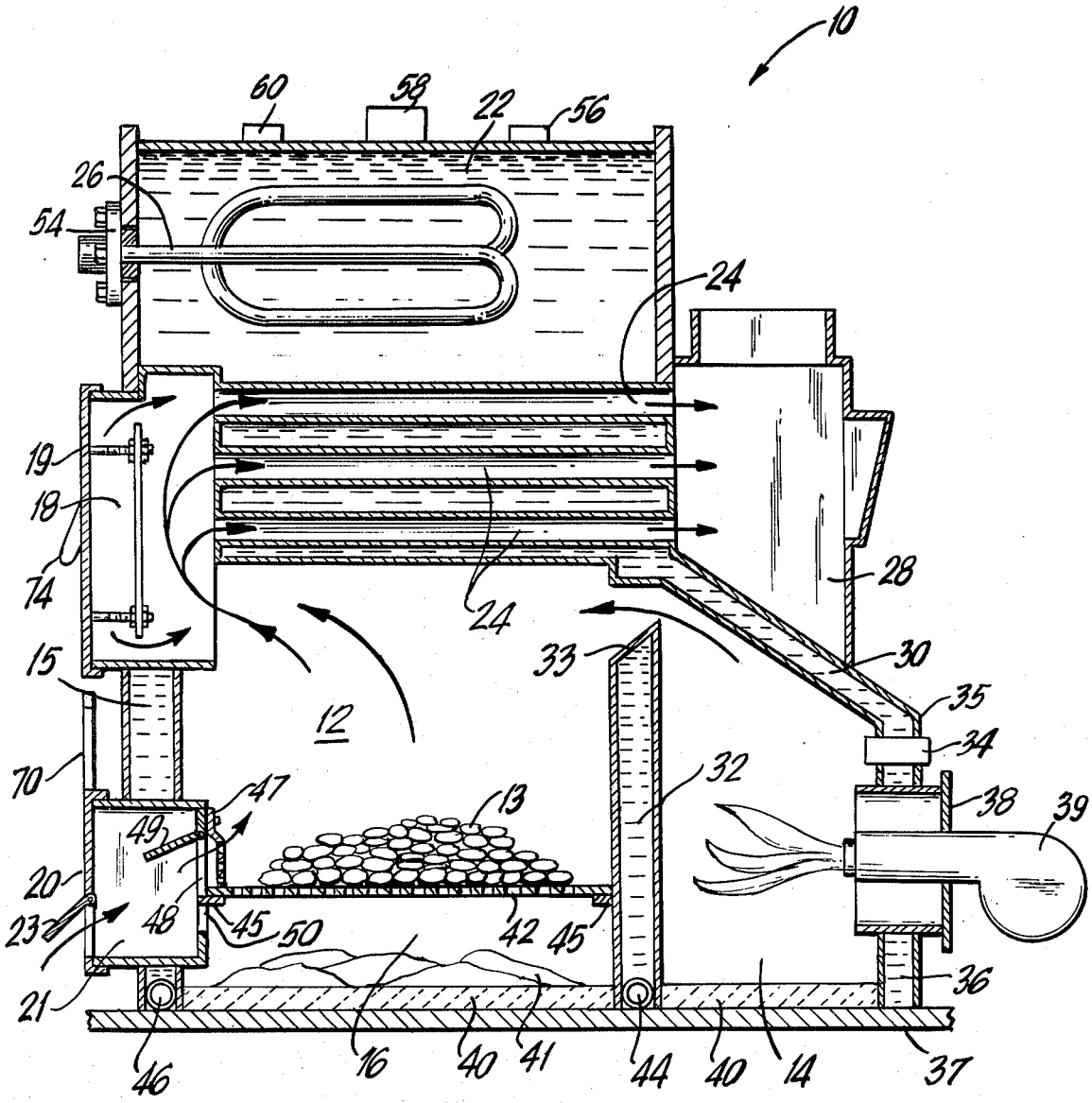
FIG. 1 is a vertical cross-sectional view of the novel boiler of this invention.

The preferred embodiment of the improved boiler 10 is shown in detail in FIGS. 1–4. The boiler 10 comprises a front compartment 12 having at least one water-conductive wall 15, a rear fire compartment 14 positioned behind said front-compartment 12, and an ash pit 16 positioned directly below the front compartment 12 and in front of the rear compartment 14. The rear compartment 14 is totally separated from ash pit 16 and partially separated from the front compartment 12 by a vertical, water-conductive wall 32. The upper portion of the rear compartment 14 is connected to and communicates with said front compartment 12. The exterior walls 15 and internal wall 32 are preferably constructed of a heavy duty steel plate 35. The term "water-conductive wall" refers to an enclosed water-tight metal structure through which water is conducted, either by convection current or by pumping, and which is used as an internal or external wall of the boiler.

Immediately above the front compartment 12 is a water supply tank 22. A plurality of horizontal preferably cylindrical, fire tubes 24 pass through the bottom portion of the water tank 22. Each fire tube 24 connects the front compartment 12 to a flue 28 so that hot gases formed in the front compartment 12 and rear compartment 14 pass through the fire tubes 24 heating the water in the water supply tank 22. The water-conductive walls 15 and 32 are connected to the water supply tank 22 so that heat passing to the exterior wall 15 and wall 32 also heats the water within supply tank 22 to form hot water or steam.

The rear compartment 14 comprises a refractory floor slab 40; a water-conductive exterior rear wall 36 having therein a preferably cylindrical oil burner port 38; and an oil burner 39 held in the rear compartment 14 by the port 38. The rear compartment 14 also has a water-conductive ceiling 30 slanting upwardly toward the front compartment and connected to water supply tank 22. The vertical interior wall 32 separating partially the rear compartment 14 from the front compartment 12 is beveled so that the upper edge 33 of the wall 32 slants upwardly toward the water-conductive ceiling 30. The water-conductive ceiling 30 and the interior water-conductive wall 32 provide maximum efficiency for heat transfer from hot gases formed in the fire compartment 14 to water supply tank 22. A water return inlet 44 is preferably provided at the base of the wall 32. An inspection port 34 is provided in rear wall 36.

The front compartment 12 is separated from the ash pit 16 by a preferably horizontal rectangular grate 42, for solid fuel 13 resting on grate support rails 45 attached to wall 32 and frame 21. The solid fuel may be wood, preferably seasoned oak hardwood, or coal, preferably anthracite nut coal. The refractory slab 40 extends into and forms the floor of ash pit 16 as well as fire compartment 14. The slab 40 rests on bottom plate 37, preferably steel. The water-conductive exterior walls 15 are preferably provided with a flush valve 46 positioned at the bottom of the walls 15.

Figure 2:
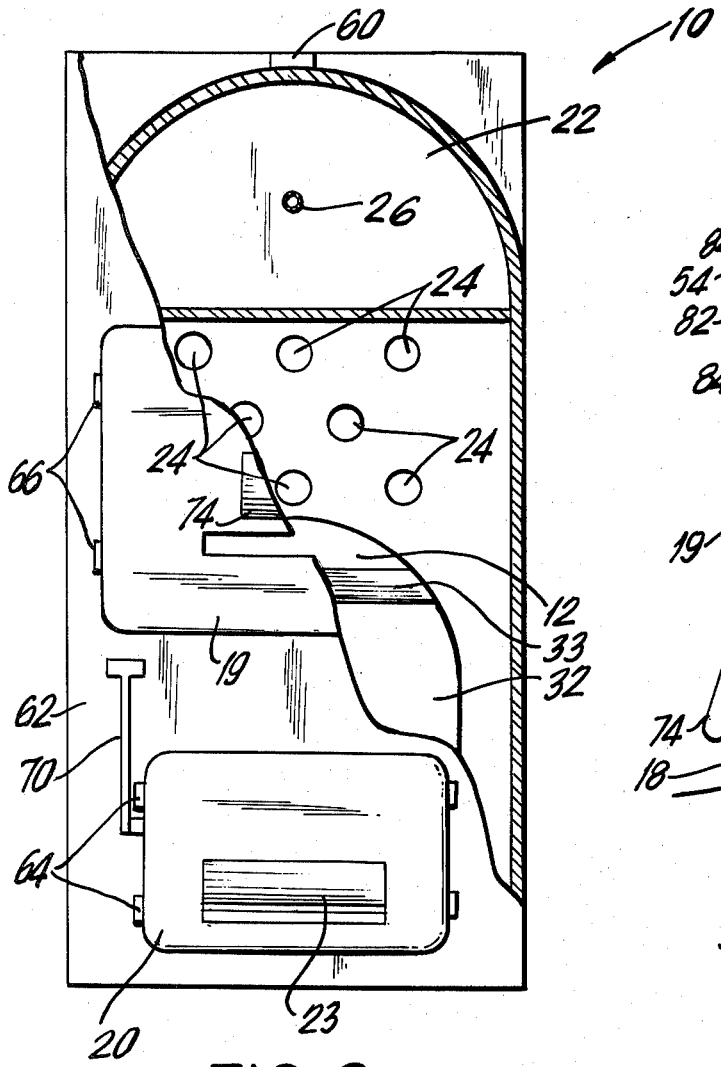
FIG. 2 is a partial cutaway front planar view of the boiler of FIG. 1.

As shown in FIGS. 1 and 2 the ash pit 16 has a preferably rectangular ash pit door 20 hung by hinges 64 on rectangular frame 21 set in the front 62 of the boiler 10. The door 20 has therein a primary damper 23, which is hinged so that it may be closed, partially opened to the extent desired, or fully opened. The ash pit door frame 21 exceeds the height of the ash pit 16 and thus provides an air passage to the front compartment 12 through vent 48 positioned in the bottom front compartment 12.

The effective size of the vent 48 is controlled by the hinged damper 49 which, under the user's control, may be closed, partially opened to the extent desired, or fully opened. The hinged damper 49 provides changes in the air flow so that the air flow may be primarily from below the grate 42, when coal is being burned, or primarily above that grate 42, i.e., through front retainer grate 47, when wood is being burned.

The dampers 23 and 49 are used to control the flow of air to the fuel. When wood is being burned as the fuel, the ash pit door 20 is closed, damper 23 opened, and the damper 49 closed so that air flows through the ash door damper 23 and then through the vent opening 50 and under the grate 42. When coal is being burned as the fuel, the ash door 20 is closed, its damper 23 is opened and the damper 49 opened, so that air flows primarily through opening 48 and then through the front retaining grate 42, although some air will also flow through grate 42.

A shaker handle 70, on the side door 20 may be used to stir coal 13, causing ashes 41 and like solid matter to fall through the said grate 42 into the ash pit 16.

Figure 3:
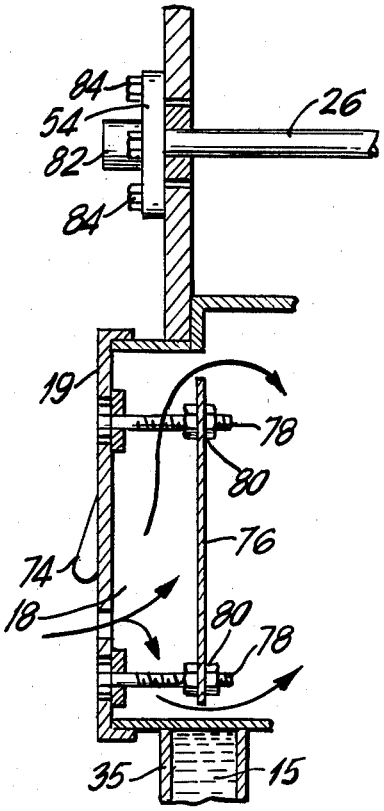
FIG. 3 is a sectional view showing structural details of the fire box door 19 shown in FIG. 1.
Figure 4:
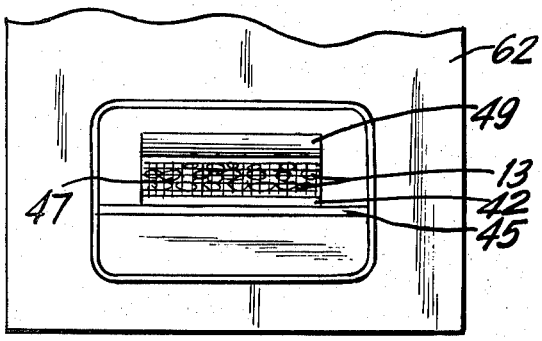
FIG. 4 is a cutaway front planar view of the improved boiler of FIG. 1 with Ash pit door 20 removed.

As shown in FIGS. 1, 2, and 3 compartment 12 is provided with a preferably rectangular firebox door 19 hung by hinges 66 on a preferably rectangular frame 18 set in the front 62 of boiler 10. The door 19 is positioned adjacent to fire tubes 24 and contains an adjustable secondary damper comprising a vertically oriented baffle 76 having vertically oriented nuts 80 attached therein and passing through there. The nuts 80 receive bolts 78, and bolts 78 pass through said door 19. The position of the baffle 76 from the door 19 can be varied by applying a torque to bolts 78 thus controlling the opening in the door and the flow of secondary air through firebox door 19. The firebox door 19 may also be provided with a handle 74.

The water supply tank 22 is preferably provided with a domestic hot water coil 26 supported by and attached to the front 62 of boiler 10 by rectangular coupling plate 54 with bolts 84. Water is passed through the coil 26 and heated by the hot water within tank 22. The plate 54 also has a coupler 82 mounted therein which provides an inlet and outlet for hot water coil 26. Water supply tank 22 is provided with a pressure relief valve 56, for steam or hot water, a supply coupler 58 and a triactor 60.

In operation, the novel boiler 10 of this invention allows use of either a solid combustible fuel, such as coal or wood, and/or a fluid fuel, oil. Thus, if either fuel is uneconomical or in short supply, the other may be used or they may be burned at the same time with the proportions of each fuel varied to fit seasonal variations. Oil is burned in rear compartment 14 and coal in front compartment 12 to heat water in exterior walls 15 and 36, internal wall 32, and slanted ceiling 30.

What is claimed is:

1. A multi-fuel boiler having improved combustion efficiency comprising two compartments, said compartments each including external walls and an internal wall partially separating the compartments from each other to permit passage of heated gas from one compartment to the other so that the fuels may be burned in each compartment in sequence or simultaneously, wherein said compartments comprise a front compartment for combustion of a solid fuel positioned and connected to and communicating with said front compartment, a rear compartment for combustion of a fluid fuel, and an ash pit positioned in front of said rear compartment and beneath said front compartment and separated from said front compartment by a grate to hold solid fuel;

means in one compartment to burn fluid fuel and means in the other compartment to burn solid fuel, a water-filled supply tank positioned above said front compartment;

wherein said internal wall between the two compartments is a substantially vertical water-conductive wall connected to said water supply tank to heat the water of said tank;

a plurality of fire tubes each having inlet and exhaust orifices, said fire tubes passing through said water supply tank, said fire tubes having their inlet orifices connected to said front compartment to receive hot combustion gases from both said compartments, said fire tubes heating the water within the supply tank and being connected to a flue for exhausting combusted gases.

2. An improved multi-fuel boiler as in claim 1 wherein at least some of said external walls are water-conductive walls connected to said water supply tank to heat the water of said tank.

3. An improved multi-fuel boiler as in claim 1 wherein the fluid fuel compartment has an elongated water-conductive wall connected to said water supply tank to heat the water of said tank.

4. An improved multi-fuel boiler according to claim 1 wherein at least one of said compartments has an adjustable secondary damper for providing a variable flow of secondary air to improve combustion efficiency.

5. An improved multi-fuel boiler according to claim 1, wherein, said fire tubes are substantially horizontal and said floor of said front compartment and said ash pit is a refractory slab.

6. An improved multi-fuel boiler according to claim 5 wherein said front compartment has a fire box door having an adjustable secondary damper, said adjustable secondary damper comprising a substantially vertical planar baffle mounted interiorly and spaced horizontally therefrom by bolts passing through said door to engage nuts embedded in and penetrating through said baffle, said secondary air flow being admitted and adjusted by torquing said bolts thereby varying the distance between said baffle and said front compartment door.

7. An improved multi-fuel boiler according to claim 1 wherein said front compartment is partially separated from said rear compartment and said ash pit is completely separated from said rear compartment by said substantially vertical water-conductive interior wall and the upper edge of said interior wall is slanted toward said rear compartment ceiling.

8. An improved multi-fuel boiler according to claim 1 wherein said ash pit has an ash pit door having therein a primary damper for primary air for combustion and a shaker handle penetrating said ash pit door to provide a means for agitating said burning solid fuel to cause ashes and like solid matter to fall into said ash pit.

* * * * *